United States Patent [19]

Robinson

[11] Patent Number: 4,754,799

[45] Date of Patent: Jul. 5, 1988

[54] PROCESS FOR DIE-CASTING ALUMINUM ALLOYS OF LOW IRON AND HIGH ALUMINUM CONTENT

[76] Inventor: Ronald K. Robinson, 14533 Fairford Ave., Norwalk, Calif. 90650

[21] Appl. No.: 13,462

[22] Filed: Feb. 11, 1987

[51] Int. Cl.[4] ..... B22D 17/10

[52] U.S. Cl. ..... 164/113; 164/312

[58] Field of Search ..... 164/113, 119, 120, 133, 164/136, 303, 312, 457

[56] References Cited

U.S. PATENT DOCUMENTS 3,369,591 2/1968 Welch et al. ..... 164/113

FOREIGN PATENT DOCUMENTS 53-34629 3/1978 Japan ..... 164/113

59-189055 10/1984 Japan ..... 164/113

*Primary Examiner*—Nicholas P. Godici

*Assistant Examiner*—Richard K. Seidel

*Attorney, Agent, or Firm*—Jackson & Jones

[57] ABSTRACT

A process is disclosed for die-casting aluminum alloy A365.2, or like alloys having high aluminum and low iron content, which have hitherto not been formed into parts in die-casting processes because of undesirable soldering of the cast part to the steel die. In the disclosed process the molten aluminum alloy containing a maximum of 0.12 percent iron and at least 90 percent aluminum is injected under pressure into a die through a gate at an injection rate which is approximately 55 to 93 cubic inch per second. When the rate of injection of the aluminum alloy into the die is in this range, there is no sticking or soldering of the die-cast part to the steel walls of the die.

24 Claims, 2 Drawing Sheets

PROCESS FOR DIE-CASTING ALUMINUM ALLOYS OF LOW IRON AND HIGH ALUMINUM CONTENT

BACKGROUND OF THE INVENTION

1. Field of the Invention

The present invention is in the field of die-casting metal alloys. More particularly, the present invention is in the field of die-casting aluminum alloys of low iron and high aluminum content.

2. Brief Description of the Prior Art

It has been established practice in the prior art to die-cast aluminum alloys of relatively high iron content. Such an alloy is for example the "380 aluminum" which is well known in the art, and has the following approximate composition: 83.75% aluminum; 0.09% magnesium; 9.24% silicone: 2.86% zinc; 0.78% iron; 3.13% copper and 0.15% manganese. According to manufacturer's specifications "380 aluminum" may contain up to 1.0% iron.

As is known in the art and is also apparent from the abovegiven composition of "380 aluminum" alloy, the aluminum content of this alloy is relatively low, while the 0.78% iron content is considered high. "380 aluminum" or like low aluminum - high iron alloys have only mediocre mechanical and related metallurgic properties and are, generally speaking, not considered suitable for parts which must have high mechanical strength. For example, "380 aluminum" and like alloys are generally not considered suitable for fabrication of aircraft parts. Nor can "380 aluminum" or like aluminum alloys, be heat treated to significantly improve their mechanical properties.

On the other hand, "380 aluminum" or like aluminum alloys of high iron content have the significant advantage that they can be die-cast. As is known, die-casting is a process which is often utilized for relatively inexpensive mass production of a multitude of identical parts. Moreover, close tolerances and fine structural detail can be attained and reliably reproduced by die-casting.

It is generally understood in the art that the relatively high iron content of "380 aluminum" renders it possible for this alloy to be die-cast. More specifically, it is understood that the high iron content of this or like alloys prevents sticking or soldering of the die-cast part to the steel die.

In contrast to the die-castable properties of "380 aluminum alloy", aluminum alloys having high aluminum and low iron content were not considered die-castable in the prior art even though these alloys have much more desirable mechanical properties than the "380 aluminum" alloy. Alcoa aluminum alloy A356.2 ("alloy 356") is an example of such an alloy, which contains more than 90% aluminum and no more than 0.12% iron. Alloy 356 has very desirable mechanical properties and is suitable for fabrication of parts requiring high mechanical strength. Alloy 356 can also be heat treated to improve its mechanical properties. Alloy 356 is suitable, for example, for use in certain aircraft parts.

Up to the present invention, however, the prior art has been unable to die-cast "alloy 356", or like aluminum alloys of high aluminum and low iron content. In this connection the experience in the prior art has been that when die-casting is attempted of such high aluminum and low iron containing alloys, the cast part sticks or solders to the steel die, making successful casting of the part impossible. It is widely believed in the art that the absence of sufficient iron from these high purity - high strength aluminum alloys causes the above-noted undesirable soldering phenomenon.

In light of the foregoing, when manufacturing parts from "alloy 356" (or from like alloys) it has been necessary in the prior art to utilize the well known "investment casting" or "permanent mold casting" processes. A well known disadvantage of these processes, however, is that they are much less suitable for mass production than the die-casting process. Moreover, the investment casting and permanent mold casting processes are able to produce parts of lesser dimensional tolerances and having lesser fine details than comparable parts produced by die-casting.

Generally speaking, it has been estimated that die-casting an aluminum part, as compared to investment casting or permanent mold casting, can reduce the cost of the part approximately three to five fold while permitting production of parts having closer dimensional tolerances and finer detail. In light of the foregoing, there is a definite need in the prior art for a process for die-casting "alloy 356" and like alloys of high aluminum and low iron content. The present invention satisfies this need.

SUMMARY OF THE INVENTION

It is an object of the present invention to provide a process for die-casting aluminum alloys of high aluminum and low iron content, such as Alcoa "alloy 356".

The foregoing and other objects and advantages are attained by a process wherein molten aluminum alloy of high aluminum and low iron content, such as Alcoa "alloy 356" containing a maximum of 0.12 percent iron and at least 90 percent aluminum, is forced under pressure into a die through a gate at a flow rate which is approximately 55 to 93 cubic inch per second. When the rate of injection of the aluminum into the die is in the above-defined range, there is no sticking or soldering of the die-cast part to the steel walls of the die.

The features of the present invention, together with further objects and advantages, can be best understood from the following description taken in conjunction with the accompanying drawings wherein like numerals indicate like parts.

DESCRIPTION OF THE SPECIFIC EMBODIMENTS

The following specification taken in conjunction with the drawings sets forth the preferred embodiments of the present invention. The embodiments disclosed herein are the best modes contemplated by the inventor for carrying out his invention in a commercial environment, although it should be understood that several modifications of the present invention are possible without departing from the scope of the invention.

It has been discovered in accordance with the present invention that aluminum alloys of high aluminum and low iron content can be successfully fabricated into parts by die-casting, provided the rate of injecting or forcing the molten aluminum alloy into a die cavity proceeds at a rate which is significantly slower than comparable injection rates for aluminum alloys of relatively low aluminum and high iron content.

More specifically, Alcoa alloy 356 more precisely stated provides an example of an aluminum alloy of high aluminum and low iron content, which also has excellent mechanical properties making this alloy suitable for fabrication of parts requiring great mechanical strength. In contrast to a "secondary" low aluminum and high iron containing alloys, such as "380 aluminum" (the composition of which is recited in the introductory section of this application for patent), Alcoa alloy 356 is a primary alloy and contains more than 90 percent aluminum and no more than 0.12 percent iron.

The approximate composition of a typical "alloy 356" sample is as follows: 92.42 percent aluminum, 7 percent silicone, 0.12 percent iron, 0.01 percent copper, 0.35 percent magnesium and 0.10 percent titanium. This alloy can even be heat treated to improve its mechanical properties.

The ensuing description discloses the process of the present invention as the process is practiced on the above-mentioned Alcoa "alloy 356", although it should be understood that the invention is not limited to this specific alloy. Rather, the invention is applicable to aluminum alloys containing more than approximately 90 percent aluminum and low percentage of iron, as these terms are understood by those skilled in the art. It should be further understood that the aluminum alloys to which the present invention applies are alloys which hitherto have not been successfully die-cast because their low iron content has caused a tendency for the cast part to solder to the steel die.

Figure 1:
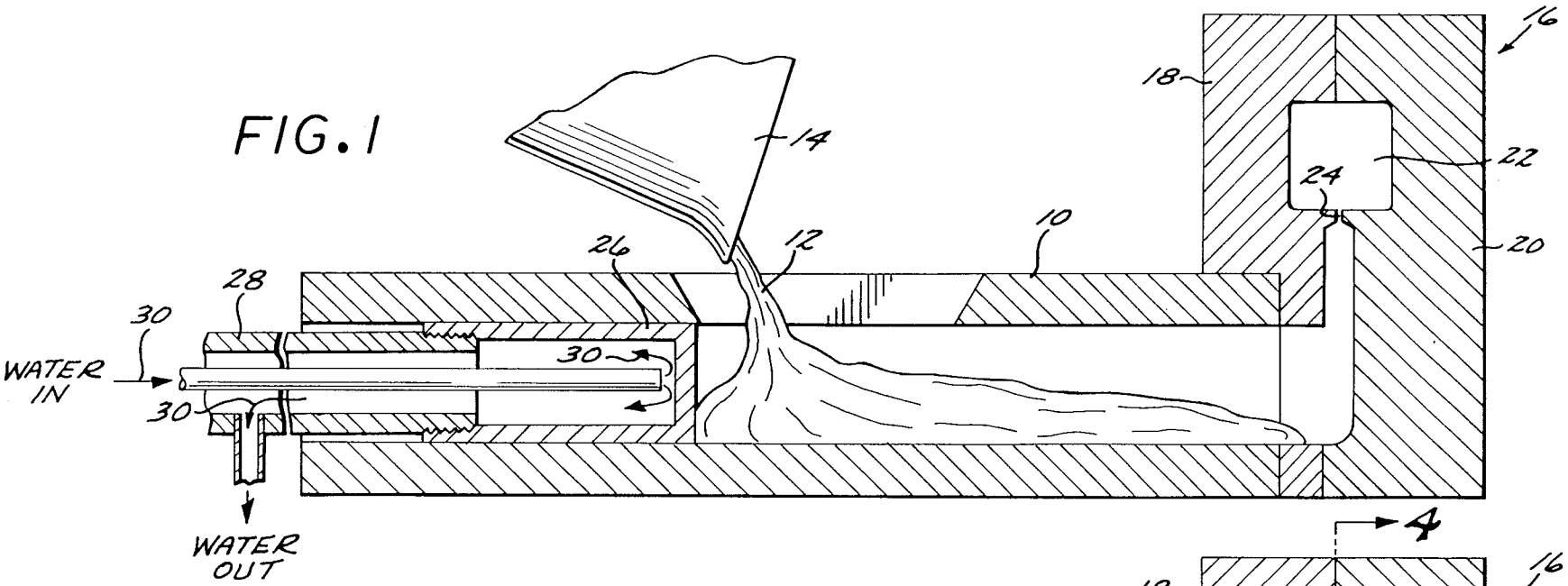
FIG. 1 is a schematic representation of a step in the process of the present invention, wherein molten aluminum alloy is poured into a cylinder of a suitable die-casting machine.
Figure 2:
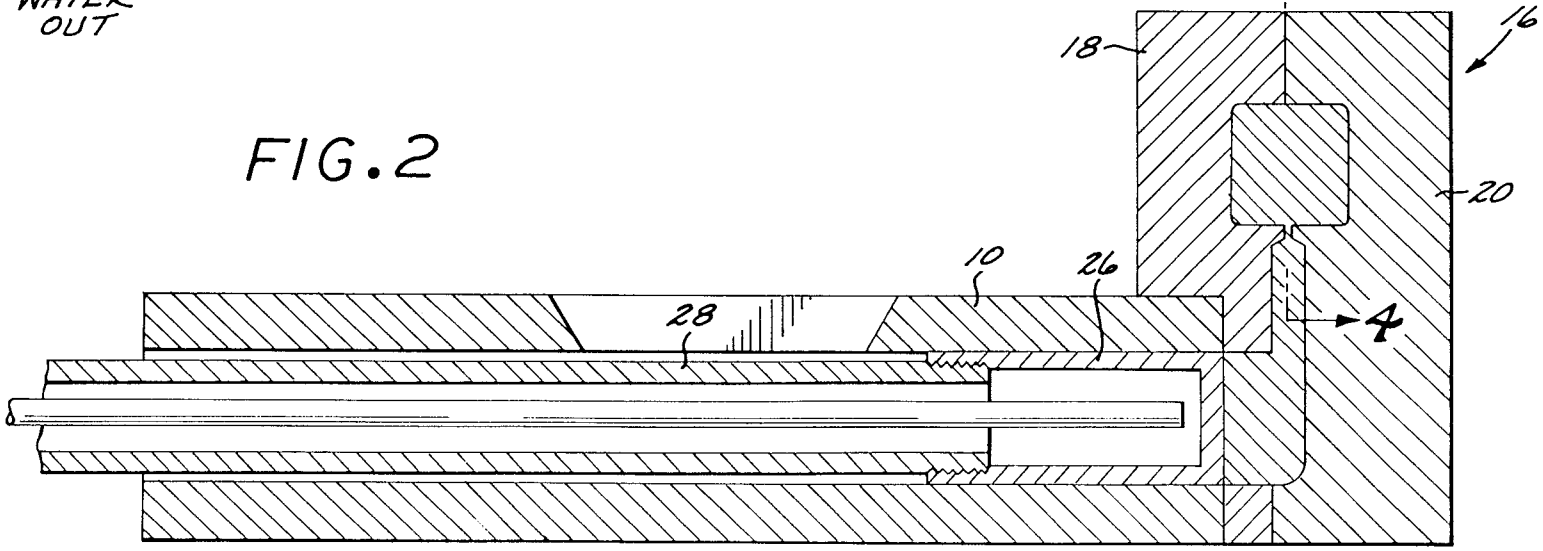
FIG. 2 is a schematic representation of another step in the process of the present invention, wherein molten aluminum alloy is forced through a gate into a die cavity.
Figure 3:
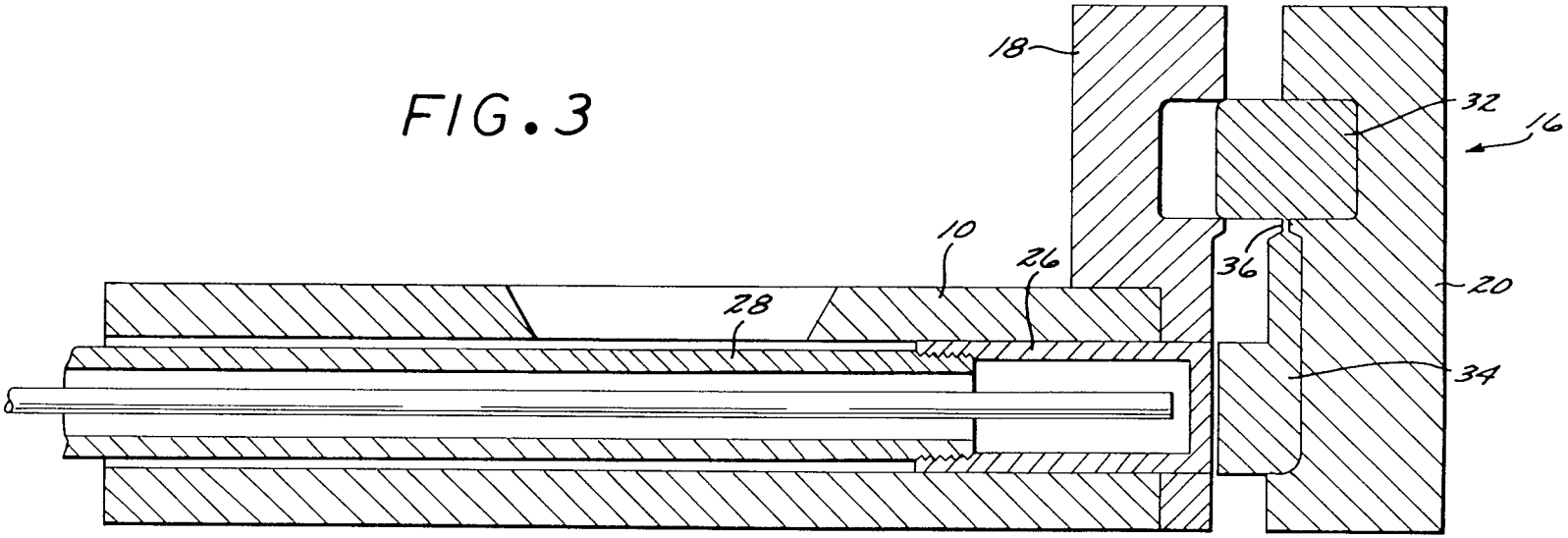
FIG. 3 is a schematic representation of still another step in the process of the present invention, wherein the cast aluminum alloy part is removed from the die.

FIGS. 1–3 of the appended drawings schematically represents parts of a die-casting apparatus or machine wherein the process of the present invention may be practiced. It should be expressly understood that the die-casting apparatus or machine is well known in the art, and that the machine itself forms no part of the present invention.

As is known in the art, the die-casting apparatus includes a cylinder 10 into which molten aluminum alloy 12 is poured from a ladle 14. The cylinder 10 is operatively mounted to a die 16 having a first part 18 and a second part 20. The first and second parts 18 and 20 of the die 16 jointly form a die cavity 22, which in turn defines the shape of the article or part to be made by the die-casting process.

The first and second parts 18 and 20 of the die 16 are movable relative to one another, so that the formed part can be removed from the die 16. The cylinder 10 is in fluid communication with the die cavity 22 so that the molten aluminum alloy 12 can be forced to flow from the cylinder 10 into the die cavity 22. A relatively small opening, termed as a gate 24 in the art, forms the narrowest part of the fluid path between the cylinder 10 and the die cavity 22. In some die-casting processes more than one gate may be used.

A piston 26 is mounted into the cylinder 10 for the purpose of forcing under pressure the molten aluminum alloy 12 through the gate 24 into the die cavity 22. As is schematically shown on FIGS. 1–3, the piston 26 is threadedly mounted to an actuating shaft 28, and is internally cooled with water. The arrow indicating the flow of water in the piston 26 bear the reference numeral 30. Although this is not shown on the drawings. the die 16 is usually also cooled with circulating water.

To force the molten aluminum alloy 12 from the cylinder 10 into the die cavity 22 the piston 26 travels in the cylinder 10 from left to right. FIG. 1 schematically indicates the position of the piston 26 while molten alloy 12 is placed into the cylinder 10. FIG. 2 schematically indicates the position of the piston 26 in the cylinder when the die cavity 22 is filled with the molten alloy 12. FIG. 3 schematically indicates yet another position of the piston 22 in the cylinder 10 where the first and second parts 18 and 20 of the die 16 have separated and the piston 22 pushes the solid cast part 32 together with a puck 34 out of the die 16.

It is a novel and important feature of the present invention that to avoid sticking or soldering of the cast Alcoa alloy 356 (or like high aluminum low iron alloy) part 32 to the die 16, the rate of injecting the molten 356 alloy into the die cavity 22 through the gate 24 (or gates 24 if there is more than one gate) is in the range of approximately 55 to 93 cubic inches of molten alloy per second (inch$^3$/second). This range of the rate of injecting the molten alloy into the die cavity applies to parts of varying sizes, substantially independently of the weight or size of the article or part to be cast.

A more preferred range for the rate of injecting the molten alloy 356 into the die cavity 22 is approximately 67 to 82 inch$^3$/second.

Figure 4:
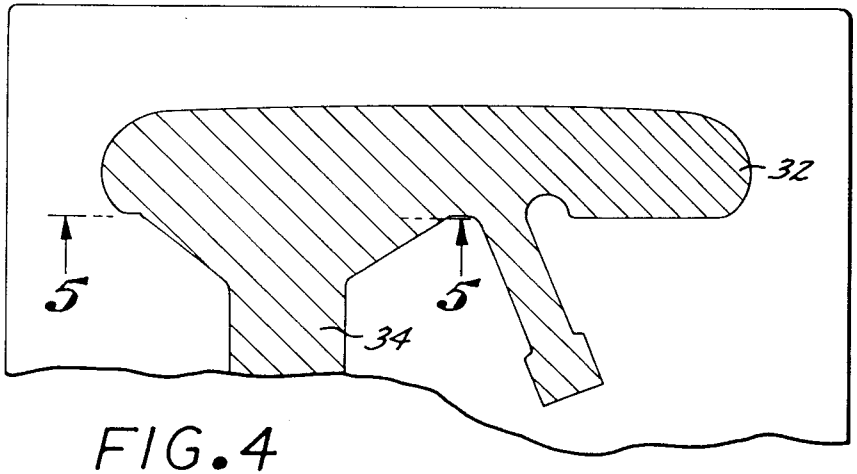
FIG. 4 is a cross-sectional view of a part which is cast from the aluminum alloy in accordance with the present invention, the view showing a bisquit still attached to the part.

A most preferred rate of injection, in accordance with the invention, is approximately 74 inch$^3$/second. The above-noted most preferred injection rate is utilized in an actual example of the process of the invention wherein parts of approximately 3.4 to 6.2 ounce weight are cast from Alcoa alloy 356 on a 350 ton horizontal die cast machine with a molten alloy temperature of approximately 1290° F., and a piston pressure (shot pressure) of approximately 999.6 PSI (70 kg/cm$^2$), with an intensification pressure of approximately 3498.6 PSI (245 kg/cm$^2$) cutting in at approximately 0.2 seconds. The part cast in accordance with the invention in the herein given example is a head of "putting" gulf club. This part 32 is shown on FIGS. 4 and 5.

The size of the gate 24 plays a role in the practice of the present invention, and is to be kept approximately between 0.06 to 0.12 inch$^2$. It should be understood in this regard that the above noted gate size indicates the cross-sectional area available in the gate 24 for flow of the molten alloy 12 into the die cavity 22.

In the above given specific example of casting parts of 3.4 and 6.2 ounce weight, the actual gate sizes are 2.00"×0.040" and 2.50"×0.40", respectively.

The temperature of the molten Alcoa alloy 356 is ideally kept at the above-noted 1290° F. for the herein described casting process. A possible temperature range is between approximately 1280° F. to 1300° F. for the reasons that too high temperatures tend to burn the magnesium contained in the alloy, and too low temperatures do not provide sufficient fluidity to the molten alloy.

As it will be readily understood by those skilled in the art, the above noted injection rates of the molten high aluminum and low iron containing alloy into the die cavity 22 are significantly slower than comparable injection rates which would be utilized in accordance with the state of the art for casting comparable parts on the same die-casting machine from low aluminum and high iron containing alloys. For example, in order to make the same gulf club head of 6.2 ounce weight in the same die 16 from "380 aluminum" approximately 3.3 times greater injection rates would be ordinarily used than the actual injection rate of 74.16 inch$^3$/second utilized in the herein given example.

Generally speaking, the rate of injection of molten alloy 356 (or like alloy) into the die cavity in accordance with the present invention, is approximately two to four times slower than the rate of injection of molten "380 aluminum" (or like alloy) would be into the same die cavity in accordance with the state of the art, such rate being in the range of 110 to 372 inch$^3$/second, depending on gate size and other factors, as is known in the art.

Referring now again to FIGS. 1–3 it should be apparent to those skilled in the art that the rate of injecting molten alloy 12 into the die cavity 22 depends on the rate of movement of the piston 26 in the cylinder 10. The rate of movement of the piston 26 in the cylinder of a die-casting machine is often referred to in the art as "ram velocity". In the herein given specific example, the internal diameter of the cylinder 10 of the die-casting apparatus is 2.00". The diameter of the piston 26 is also 2.00". The shot sleeve in the apparatus is 17.5" long. The ram velocity is 23.62 inch/second, which means that the molten alloy 12 is forced out of the cylinder 10 at the rate of 74.16 inch$^3$/second.

For the just described die-casting apparatus having a piston 26 of 2.00" diameter, the injection rate of 55 to 93 inch$^3$/second means a ram velocity range of approximately 18 to 30 inch/second. The more preferred injection rate of 67 to 82 inch$^3$/second means a ram velocity range of approximately 21 to 26 inch/second.

Figure 5:
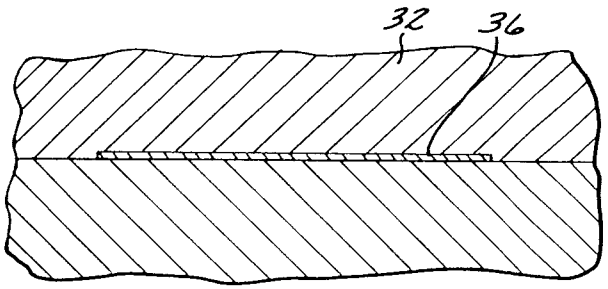
FIG. 5 is a cross-sectional view of the part and bisquit shown on FIG. 4, the cross-section being taken on lines 5,5 of FIG. 4.

FIG. 5 shows a narrow strip 36 of solid cast aluminum alloy which corresponds to the gate 24 area of 2.50"×0.40" actually used for making the 6.2 ounce part in the above given specific example. This narrow strip or piece 36 of alloy connects the puck 34 with the desired part 32, and is readily severed by techniques well known in the art.

What has been described above is a process for die-casting aluminum alloy 356, or like alloys of high aluminum and low iron content. Several modifications of the process of the present invention may become readily apparent to those skilled in the art in light of the foregoing disclosure. Therefore, the scope of the invention should be interpreted solely from the following claims, as such claims are read in light of the disclosure.

What is claimed is:

1. A process for die casting an aluminum alloy of high aluminum and low iron content, the process comprising the steps of:

depositing the molten alloy of high aluminum and low iron content into a cylinder of a die casting machine, the cylinder being in fluid communication through a gate of given definite dimensions with a die cavity of a desired configuration, and moving under pressure a piston in the cylinder so as to introduce the molten alloy into the die cavity, the movement of the piston in the cylinder being such that the rate of introduction of the molten aluminum alloy of high aluminum and low iron content into the die cavity through the gate, expressed in units of volume in a unit of time, is approximately two to four times slower than the rate of introduction of molten aluminum alloy of low aluminum and high iron content, such as 380 aluminum alloy, would be under comparable circumstances and through a gate of the same definite dimensions, into the same die cavity, said rate of introduction of molten aluminum alloy of low aluminum and high iron content, such as the rate of introduction of 380 aluminum alloy, into the die cavity being in the range of 110 to 372 inch$^3$/second, depending on gate size.

2. The process for die-casting of claim 1 wherein the alloy of high aluminum and low iron content comprises approximately 0.12 percent or less iron.

3. The process for die-casting of claim 2 wherein the alloy of high aluminum and low iron content comprises approximately 90 percent or more aluminum.

4. The process for die-casting of claim 1 wherein the alloy of high aluminum and low iron content is Alcoa primary alloy 356.

5. A process for die-casting an aluminum alloy of high aluminum and low iron content, such as Alcoa primary alloy 356, the process comprising the steps of:

depositing the molten aluminum alloy of high aluminum and low iron content into a cylinder of a die casting machine, the cylinder being in fluid communication through a gate with a die cavity of a desired configuration, and moving under pressure a piston in the cylinder so as to force the molten alloy through the gate into the die cavity, the movement of the piston in the cylinder being at a rate such that the rate of flow of the molten aluminum alloy through the gate into the die cavity is approximately 55 to 93 inch$^3$/second.

6. The process of claim 5 wherein the movement of the piston in the cylinder is at a rate such that the rate of flow of the molten aluminum alloy through the gate into the die cavity is approximately 67 to 82 inch$^3$/second.

7. The process of claim 6 wherein the movement of the piston in the cylinder is at a rate such that the rate of flow of the molten aluminum alloy through the gate into the die cavity is approximately 74 inch$^3$/second.

8. The process of claim 5 wherein the aluminum alloy has a maximum iron content of approximately 0.12 percent by weight.

9. The process of claim 5 wherein the aluminum alloy has a minimum aluminum content of approximately 90 percent by weight.

10. The process of claim 5 wherein the aluminum alloy consists essentially of approximately 92.42 percent aluminum, 7 percent silicone, 0.12 percent iron, 0.01 percent copper, 0.35 percent magnesium and 0.10 percent titanium.

11. The process of claim 5 wherein the piston has a diameter of approximately two inches, and wherein during the step of moving the piston advances in the cylinder at a rate of approximately 18 to 30 lineal inch/second.

12. The process of claim 11 wherein the piston advances in the cylinder at a rate of approximately 21 to 26 lineal inch/second.

13. The process of claim 12 wherein the piston advances in the cylinder at a rate of approximately 23.6 lineal inch/second.

14. The process of claim 11 wherein during the step of moving the pressure of the piston is approximately 999.6 psi.

15. The process of claim 5 wherein the weight of the article cast in the mold in the process is in the range of approximately 3 to 7 ounces.

16. The process of claim 15 wherein the gate has a cross-sectional area through which the molten aluminum flows, of approximately 0.06 to 0.12 $inch^2$.

17. A process for die-casting articles from Alcoa primary 356 aluminum alloy, said alloy having an iron content which does not exceed 0.12 percent, the process comprising the steps of:

depositing the molten aluminum alloy into a cylinder of a die casting machine, the cylinder being in fluid communication through a gate with a die cavity of a desired configuration, the die cavity being such that the aluminum article cast in the cavity weighs approximately 3 to 7 ounces, and the gate having a cross-sectional area available for fluid flow in the range of 0.06 to 0.12 $inch^2$, moving under pressure a piston in the cylinder so as to force the molten alloy through the gate into the die cavity the movement of the piston in the cylinder being at a rate such that the rate of flow of the molten aluminum alloy through the gate into the die cavity is approximately 67 to 82 $inch^3$/second.

18. The procees of claim 17 wherein the piston has a diameter of approximately two inches and advances in the cylinder at a rate of approximately 23 to 24 lineal inch/second.

19. The process of claim 17 wherein the primary 356 aluminum alloy consists essentially of approximately 92.42 percent aluminum, 7 percent silicone, 0.12 percent iron, 0.01 copper, 0.35 magnesium and 0.10 titanium.

20. A process for die-casting an aluminum alloy of high aluminum and low iron content, such as Alcoa primary alloy 356, the process comprising the steps of:

forcing under pressure the molten aluminum alloy of high aluminum and low iron content to flow through a gate into a die cavity of a desired configuration, the rate of flow of the molten aluminum alloy through the gate into the die cavity being approximately 55 to 93 $inch^3$/second.

21. The process of claim 20 wherein the rate of flow of the molten aluminum alloy through the gate into the die cavity is approximately 67 to 82 $inch^3$/second.

22. The process of claim 21 wherein the rate of flow of the molten aluminum alloy through the gate into the die cavity is approximately 74 $inch^3$/second.

23. The process of claim 20 wherein the gate has a cross-sectional area through which the molten aluminum alloy flows, of approximately 0.06 to 0.12 $inch^2$.

24. The process of claim 20 wherein the aluminum alloy consists essentially of approximately 92.42 percent aluminum, 7 percent silicone, 0.12 percent iron, 0.01 copper, 0.35 magnesium and 0.10 titanium.

* * * * *